US008490442B1

(12) United States Patent
Dapkins, Jr. et al.

(10) Patent No.: US 8,490,442 B1
(45) Date of Patent: Jul. 23, 2013

(54) FLEXIBLE DISPOSABLE LIGHTWEIGHT SECURE HANDCUFF SYSTEM

(75) Inventors: John A Dapkins, Jr., Bloomsbury, NJ (US); Nicholas Klementowicz, III, Hillsborough, NJ (US)

(73) Assignee: Jersey Tactical Corporation, Lopatcong, NJ (US)

( * ) Notice: Subject to any disclaimer, the term of this patent is extended or adjusted under 35 U.S.C. 154(b) by 0 days.

(21) Appl. No.: 13/506,180

(22) Filed: Apr. 2, 2012

(51) Int. Cl.
*E05B 75/00* (2006.01)

(52) U.S. Cl.
USPC ..... 70/16; 24/16 PB

(58) Field of Classification Search
USPC ..... 70/14–17; 24/16 PB
See application file for complete search history.

(56) References Cited

U.S. PATENT DOCUMENTS

| | | | | | |
|---|---|---|---|---|---|
| 4,071,023 | A | | 1/1978 | Gregory | 128/878 |
| 4,854,138 | A | | 8/1989 | Charland | 70/16 |
| 4,909,051 | A | | 3/1990 | Lee | 70/16 |
| 4,910,831 | A | * | 3/1990 | Bingold | 70/16 |
| 4,964,419 | A | | 10/1990 | Karriker | 128/879 |
| 5,083,346 | A | * | 1/1992 | Orton | 24/16 PB |
| 5,088,158 | A | | 2/1992 | Burkolder | 24/16 PB |
| 5,159,728 | A | | 11/1992 | Bingold | 24/16 PB |
| 5,193,254 | A | | 3/1993 | Geisinger | 24/484 |
| 5,398,383 | A | * | 3/1995 | Bingold | 70/16 |
| D366,733 | S | | 1/1996 | Stanchin | D29/120.2 |
| 5,651,376 | A | * | 7/1997 | Thompson | 128/878 |
| 5,797,404 | A | | 8/1998 | Stanchin, II | 128/869 |
| 5,802,888 | A | * | 9/1998 | Parsons | 70/16 |
| 6,219,887 | B1 | * | 4/2001 | Parsons | 70/16 |
| 6,532,631 | B2 | * | 3/2003 | Rohaly et al. | 70/16 |
| 6,539,589 | B2 | * | 4/2003 | Thompson | 70/16 |
| 7,882,599 | B2 | | 2/2011 | Harrington | 24/17 AP |
| 2011/0167880 | A1 | * | 7/2011 | Klementowicz et al. | 70/16 |

OTHER PUBLICATIONS

"Jersey Tactical" http://www.jerseytactical.com/news/news/.htm.

* cited by examiner

*Primary Examiner* — Christopher Boswell
(74) *Attorney, Agent, or Firm* — Ernest D. Buff; Ernest D. Buff & Assoc LLC; Margaret A. LaCroix, Esq.

(57) ABSTRACT

A compact, lightweight, polymeric injection molded handcuff has a strap with a distal free end and a substantially rectangular head. The strap has knife grabbing features that include a plurality of hillocks with valleys therebetween. The strap head has an aperture surrounded by a deformable frame carrying an integrally molded slanted knife with a sharp knife-edge. The strap's distal end is inserted into the head's aperture and a ring is inserted half way therealong to form two loops for inserting a prisoner's hands therethrough. When the distal end of the strap is pulled to tighten the handcuff, the knife-edge rides the hillocks, which interfere therewith owing to deformation of the head's rectangular portion. Upon clearing the hillocks, the knife comes to rest in one of the valleys, thereby securing the prisoner. Attempts by the prisoner to release the handcuff dig the slanted knife-edge into an adjacent hillock, locking the handcuff.

12 Claims, 5 Drawing Sheets

PRIOR ART

FLEXIBLE DISPOSABLE LIGHTWEIGHT SECURE HANDCUFF SYSTEM

BACKGROUND OF THE INVENTION

1. Field of the Invention

The present invention relates to handcuffs; and, more particularly, to disposable, flexible, compact, lightweight handcuffs having sufficient pull out strength to prevent escape of a detainee whose hands or legs are secured using a single flexible strap device.

2. Description of the Prior Art

Many patents address issues related to creating handcuffs for securing and retaining prisoners and detainees. Many of these devices are heavy and need keys and locks and the like and require two hand operation.

U.S. Pat. No. 4,071,023 to Gregory discloses a restraining device. The restraining device has an elongated body portion and a pair of arms extending outwardly from the body portion. The first arm has a sharp end that engages with the locking means at the proximal end of the elongated body forming a closed loop for securing one hand of a detainee. The second arm has locking mean provided at the tip distal from the elongated body and engages with the distal sharp end of the elongated body forming a second closed loop securing the other hand of the detainee. The locking means for both the closed loops are individually adjustable and includes a rigid metallic or polymeric member with integrally formed spike that engage the polymeric elongated body. The locking mechanism cannot provide sufficient restraining force to secure a handcuffed detainee since each of the spike may break one at a time.

U.S. Pat. No. 4,854,138 to Charland discloses a restraining device. The restraining device has a flexible braid of a soft of a strong material, such as a flat braided nylon, utilized to engage a locking block that permits the braided material to pass freely in one direction, but which prevents movement of the material in an opposite direction. The locking block has two apertures with a pair of cantilevered jaw members that permit free movement in one direction but engage the braid when pulled in the opposite direction. In this manner the braided material, which is formed in an endless loop, may be placed about the extremities of a person whose movement is controlled or restrained, when the loop tightened. The flexible material will tightly encircle the extremities sufficient to control or restrain their movement, but will not cut or gouge the person being restrained unless such person attempts to remove the restraining device. Because of the lightweight and inexpensive nature of the restraining device a law enforcement officer can carry a number of these devices when on duty to facilitate arrests and control of multiple offenders. The restraining device is not a flexible handcuff but is a braided rope. It is hard to deploy owing to its tendency to twist and tangle when carried in a pocket. The device is not easily placed on a combative person.

U.S. Pat. No. 4,909,051 to Lee discloses a keeper plate for strap handcuffs. The keeper plate is provided for use with strap handcuffs and the plate in one embodiment for a single handcuff is generally rectangular, with flattened concave edges disposed on its longer sides and strap-receiving channels extending through its shorter sides. The flattened concave edges generally conform to the shape of the palm side of a human wrist and enable a strap handcuff to be tightened securely with minimized danger of cutting off circulation. The plate is elongated and has a channel for receiving one strap handcuff disposed spaced apart from a flattened concave edge at each end. This enables securing of limbs without bringing them closely together. Holes may be provided in the plates to enable tying to other straps or other objects. This device is difficult to install and requires two hands for handcuffing a person.

U.S. Pat. No. 4,964,419 to Karriker discloses keyless handcuffs. A pair of handcuffs formed of light weight plastic material, so that the handcuffs cannot be used by a prisoner as a striking weapon against a guard or police officer. A single flexible plastic cord is formed into two loop sections adapted to encircle the prisoner's wrists. Sections of the cord extend through a clamp device that can be manually operated to expand or contract the loop sections, as necessary to remove or install the handcuffs on the prisoner. This handcuff is a removable device and is not a disposable device. The tightening of the handcuff at the plastic clamp requires use of tools to adjust the lengths of straps encircling each of the wrists.

U.S. Pat. No. 5,088,158 to Burkholder discloses a restraining apparatus and method. The restraining method employs apparatus that has a body portion and two, laterally-spaced, downwardly extending flexible straps that can be looped around in opposite directions to be lockingly received by a toothed ratcheting mechanism in corresponding laterally-spaced openings of the body portion. An upwardly extending tab has an opening through which a rope can be strung to link together several restrained prisoners. Strap teeth and tab are located in limb non-contacting positions. The straps bend double about self-hinges with free ends fitting within non-ratcheted loops for pocket storage. When it is desired to withdraw the straps they may be pulled it in the opposite direction out of the opening, interaction of the ratchet teeth will prevent its withdrawal unless the ratchet member is forced upwardly against the downward bias, such as by means of a screwdriver or the like inserted between the teeth. As a result, the attachment is not capable of securely restraining a prisoner.

U.S. Pat. No. 5,159,728 to Bingold discloses a two-loop law enforcement strap restraint which is concealable, disposable and can be formed entirely of recyclable material. The two-loop strap restraint for law enforcement is lightweight, strong, inexpensive, disposable, and can be formed entirely of recyclable polymeric material, and is easy to apply and carry. This restraint has a pair of apertures in its central bridging portion for curling into a compact four-loop configuration for easily carrying several of them in an unobtrusive, concealed manner in a pocket. The restraint fits all size wrists, ankles for use in a wide variety of law enforcement situations. It has the general form of a single non-metal elongated strap of polymeric material having a pair of symmetrically positioned latching socket bosses of polymeric material located near the center of the strap with a resilient latching pawl formed of polymeric material positioned in each socket. A flexible ratchet portion of the restraint extends outwardly from each socket boss with a narrow tip pull extending outwardly from the ratchet portion to a rounded tip. In use, a tip pull is inserted through a socket opening. The resilient pawl allows the flexible ratchet portion to be drawn forwardly in an insertion direction through the socket for engaging snugly around a wrist, ankle or anchoring member, then the pawl prevents the inserted ratchet portion of the strap restraint from being moved backwardly from the socket in an extraction direction for securely holding a restrained limb (arm or leg). The socket bosses project solely toward the outside of the restraint for facilitating quickly, properly inserting tip pulls into socket mouths in the dark. The latch pawl is made from polymeric material that projects into central opening as shown in FIGS.

7 and 8 and its ability to prevent pulling out of the restraint is limited by the strength polymeric latch pawl and thus does not secure a prisoner securely.

U.S. Pat. No. 5,193,254 to Geisinger discloses a versatile self-clinching disposable restraints and bundling straps. This self-clinching disposable restraint or bundling strap has a locking head with a primary bore passing through the thickness of the head into which the tip of the tape is inserted and pulled through for locking. Two rows of ratchet teeth are provided on the upper surface of the tape. A front surface of the ratchet teeth forms an acute angle with the perpendicular axis of the ratchet teeth. A pair of cantilever pawls have a tip portion to exactly fit and successively engage each of the ratchet teeth as the tape is pulled through the locking head. A finger hole in the tape near the tip enables the user to readily pull the tape through the locking head. The ratchet teeth 2*d*, 2*e* is shaped as shown in the fragment of FIG. 9, projecting 0.04 inch (1.016 mm.) above the inside surface of the tape, and directed inwardly, forming on one surface an angle of 27 degrees with the normal to the surface and on the opposite side being normal to the surface. The dimension in a longitudinal direction of the tape of each of the teeth of the series 2*d*, 2*e* is 0.02 inch (0.508 mm.) across the top, which forms a truncated triangle, and 0.04 inch (1.016 mm.) across the bottom, ending an abutment normal to the tape surface. The normal abutments of the upwardly projecting teeth are spaced apart 0.078 inch (1.98 mm.). Thus, the cantilever pawls are made of flexible nylon plastic and a small dimension as shown at 2*d* and 2*e* and do not provide sufficient separation restraining force for the handcuffs and a prisoner may easily pry the hands off from the handcuff restraint.

U.S. Pat. No. 5,797,404 to Stanchin, II and design patent D366,733 disclose a disposable handcuff. This disposable handcuff provides a two loop expandable strap restraint for law enforcement formed from a continuous single foldable strap that is light weight, strong, inexpensive, and disposable. The disposable handcuff can be formed of readily available and readily obtainable materials including high-density polyethylene, nylon, PVC, metal, a polymer composite containing graphite fibers. The single plastic strap has a locking head. The strap may be folded when not in use and expanded and tightened around the wearer to become a form fitting versatile disposable restraint. The self-clinching disposable plastic strap terminates in a locking head into which the tip of the strap is inserted and pulled through for locking in place. These components are used in combination with a separating slip ring and elastomer retaining means for packaging. The locking head is made from the same plastic material and has limited strength. As a result, the device exhibits a low value of separation restraining capability.

U.S. Pat. No. 7,882,599 to Harrington discloses handcuff apparatus. This handcuff apparatus includes a combination locking head and strap support, which includes a first longitudinal axis. A first handcuff strap and a second handcuff strap are connected to the combination locking head and strap support. Each of the respective first and second handcuff straps is connected to the combination locking head and strap support. Both of the handcuff straps extend outward from the combination locking head and strap support from the same side of the strap support. Each of the respective handcuff straps includes a ratchet-bearing side and a smooth side, which contacts the skin of a person to be restrained. Respective strap-supported unidirectional ratchet members are located on the respective ratchet-bearing sides. The locking head and strap support is provided with a movable locking clip or member normally supported in a first or non-engagement position within a portion of the locking head.

Non-Patent Literature. "Jersey Tactical" at http://www.jerseytactical.com/news/news.htm discloses a Jersey Cuff press release dated February 2009 and appears to refer to the design patent D366,733 since the appearance of the handcuff is similar to that disclosed in the design patent. The text claims that the handcuff uses a locking mechanism that has stainless steel and does not disclose the details of the locking mechanism. The strap of the Jersey cuff is made from high strength UV stabilized material and there is no disclosure of this strap material. The cuffs are marketed in groups of four with a cutting blade present within the package, which indicates that the cuff may be for one time use only and is cut using cutters. The Jersey cuffs may be easily disassembled and reattached in multiple configurations to fit any need during emergency situations. The cuffs also allow the operator to secure two Jersey Cuffs together to form leg restraints or prisoner transport belt. The links 'Soldier Systems Review: The Jersey Cuff", 'Tech Product Network.com Features: The Jersey Cuff', 'Jersey Boot and Jersey Cuff products win top awards in the 2009 Cygnus Innovation Awards' and 'Jersey Cuff featured after the 2010 SHOT show from Las Vegas (Scroll towards bottom of page to view blog)' do not add additional information on the restraining force offered by the Jersey Cuff.

There remains a need in the art for a compact, lightweight, low cost handcuff that can be easily carried and installed. Moreover, the handcuff must restrain the hands of the prisoner with a substantial hand separation force, preferably of the order of at least 250 pounds, and cannot be easily removed by jiggling, twisting or other attempts by the prisoner. The handcuff should not accidentally tighten once set in its desired location regardless of escaping efforts by the prisoner. Such unintended tightening will result in the constriction of the blood flow to the hands resulting in pain, bruising and body damage to the handcuffed prisoner.

SUMMARY OF THE INVENTION

The invention involves a compact, lightweight, portable, easy to use handcuff that can be affixed to the wrists of a prisoner or detainee by pulling on the distal free end of the strap. The strap of the handcuff has a free end at its distal end and a head present at the proximal end. The head is generally rectangular in cross section similar to a frame and has an aperture, which receives the distal end of the strap when assembled. The rectangular frame of the head has a permanently affixed slanted knife that has a knife-edge engaging with the upper surface of the strap. The upper surface of the strap has at its distal end a smooth hand grabbing surface for about 4 to 8 inches and a plurality of hillocks and deep valleys and the strap when folded passing the distal end of the strap through the aperture in the head allows direct contact of the knife-edge of the head with the hillocks of the upper surface of the strap. The distance between the knife-edge and the top of the hillocks is a critical dimension and is generally an interference fit in that some force is required to pull the strap through the aperture in the head. A ring is inserted through the folded strap and is placed at approximately half way, thus forming two loops in the strap for the placement of the prisoner's wrists. The ring is free moving and self adjusting and may be made from steel or polymeric material such as polyamide 66 or polyamide 6 or combination thereof. The handcuff is secured by pulling the distal end of the strap that passes through the aperture of the head results in the deformation of the rectangular frame of the proximal head resulting in the tightening action of the strap against both of the prisoner's wrists. At the same time, the angled knife-edge passes over a hillock and falls into an adjacent valley. Any attempt to pull the strap immediately allows the edge of the slanted knife to dig into the adjacent hillock locking the knife at the location selection, and this locking action is further assisted by the release of the deformation of the rectangular frame of the head. Thus the handcuff is securely held at the selected location of the prisoner's wrist and defeats any attempt by the prisoner to twist or wiggle the handcuff to loosen the securing grip. Further, the handcuff does not move to a tighter location since the knife-edge is securely held in place over the strap, preventing over tightening of the handcuff and the possibility of blood flow loss by the prisoner's hands. The handcuff is removed by cutting the polymeric strap with a sharp specially designed knife since the knife-edge locking mechanism cannot be defeated by tweezers, pliers, knives and other commonly available instruments.

The steel knife must be secure when force is exerted by the prisoner to release the handcuff forcefully. The knife cannot dislodge, twist or lose close contact with the hillocks present on the upper surface of the strap. This secure attachment of the knife is accomplished by having one or more punched holes through the stainless steel blade knife. When the strap and head are molded together, the knife is placed in the location of the injection molding die that forms the rectangular portion of the head so that the molten or softened polymer flows into punched holes, which are therein provided. When the polymer hardens by cooling, these polymer passages through the holes of the knife behave similar to bolts securing the knife from any movement.

Briefly stated, the invention involves a lightweight portable easy to use handcuff that can be readily affixed to the wrists of a prisoner or detainee by a pulling on the distal free end of the strap. The strap of the handcuff has a free end at its distal end and a head present at the proximal end. The strap can be produced in many different colors. The head is generally rectangular in cross section similar to a frame and has an aperture, which receives the distal end of the strap when assembled. The rectangular frame of the head has a permanently affixed slanted knife that has a knife-edge engaging with the upper surface of the strap. The upper surface of the strap has at its distal end a smooth hand grabbing surface for about 4 to 8 inches and a plurality of hillocks and deep valleys and the strap when folded passing the distal end of the strap through the aperture in the head allows direct contact of the knife-edge of the head with the hillocks of the upper surface of the strap. The distance between the knife-edge and the top of the hillocks is a critical dimension and is generally interference fit in that some force is required to pull the strap through the aperture in the head. A ring is inserted through the folded strap and is placed at approximately half way thus forming two loops in the strap for the placement of the prisoner's wrists. The ring is free moving and self adjusting and may be made from steel or polymeric material such as polyamide 66 or polyamide 6. Preferably the ring is composed of high strength nylon, such as ST-801, a custom material used for USA Hovercrafts. Rings composed of high strength nylon, such as ST-801, are highly advantageous because they do not reflect light. In addition, such custom rings are lighter; do not make a rattle noise like metal rings do when carried collectively in a pocket; and can be produced in different colors that match or complement the many different colors available for production of the strap. The handcuff is secured by pulling the distal end of the strap that passes through the aperture of the head. This results in the deformation of the rectangular frame of the proximal head, creating a tightening action of the strap against both of the prisoner's wrists. At the same time, the angled knife-edge passes over a hillock and falls into an adjacent valley. Any attempt to pull the strap immediately allows the edge of the slanted knife to dig into the adjacent hillock, locking the knife at the location selection. This locking action is further assisted by the release of the deformation of the rectangular frame of the head. Thus the handcuff is securely held at the selected location of the prisoner's wrists and defeats any attempt by the prisoner to twist or wiggle the handcuff to loosen the securing grip. Further, the handcuff does not move to a tighter location since the knife-edge is securely held in place over the strap, preventing over tightening of the handcuff and possibility of blood flow loss by the prisoner's hands. The handcuff is removed by cutting the polymeric strap with a sharp specially designed knife, since the knife-edge locking mechanism cannot be defeated by tweezers, pliers, knives and other commonly available instruments.

Significant advantages are realized by practice of the present invention. The key features of the handcuff system, include, in combination, the features set forth below:

1) a handcuff is formed by folding an injection molded strap with a central ring, said strap having a distal end passed through an aperture in a head provided at the proximal end of the strap forming two loops for receiving two wrists of a prisoner or detainee;

2) said distal end of said strap having an upper surface with a smooth hand grabbing portion for 4 to 8 inches and the rest of the upper surface having a knife-edge grabbing surface formed by a plurality of hillocks separated by deep valleys;

3) said head at the proximal end of said strap being formed as a rectangular frame carrying a permanently bonded injection molded slanted knife with a sharp knife edge;

4) said knife having one or more holes for passing an injection molded polymer created bolt-like permanent attachment between said knife and rectangular frame of said head, preventing dislodgement of the knife;

5) said knife-edge fitting with interference against said hillocks present on the upper surface of said strap when the distal end of the strap is inserted through the aperture of said head and said strap is easily pulled through the aperture, clearing hillocks during securement of the handcuff over the wrists of the prisoner due to the elastic deformation of the rectangular frame of the head, some flex of the knife, particularly at the base of the knife where it is embedded in the material, and the forward inclination of the slanted knife attached to the rectangular frame of the head;

6) said knife-edge falling into a deep valley assisted by the release of elastic deformation of the rectangular frame of the head;

7) any movement of the strap caused by the twisting or wriggling motion of the wrists coercing the strap in a direction opposite to the insertion direction, causing the digging of the sharp knife edge into an adjacent hillock, which firmly secures the handcuff and prevents any movement, as well as over-tightening of the handcuff and restriction of blood flow into prisoner's hands;

8) the strap being provided with a pair of gussets at the attachment location between the strap and head which prevent twisting and wiggling movement of the strap from being transferred to the head and to the knife-edge, and prevent securement of the handcuff from being compromised;

whereby the handcuff is securely attached to a prisoner's wrists with a substantial separation force, preferably a separation force of up to 250 pounds, and does not loosen in response to pulling, twisting or wriggling movements by the wrists and does not become overly tight so as to constrict blood supply to the hands; and whereby, once attached, the hand cuff is not readily removed by commonly available instruments, but must instead be cut away by a specially designed cutter.

BRIEF DESCRIPTION OF THE DRAWING

The invention will be more fully understood and further advantages will become apparent when reference is had to the following detailed description of the preferred embodiments of the invention and the accompanying drawing, in which:

FIG. 1*b* is an exploded view of the pawl and ratchet arrangement used in the handcuff of FIG. 1*a;*

FIG. 2*b* is an exploded view of the head portion of the strap of the handcuff, showing the slanted knife;

FIG. 2*c* is an exploded view of the upper portion of the strap of the handcuff, showing the knife grabbing features;

DETAILED DESCRIPTION OF THE INVENTION

Figure 1A:
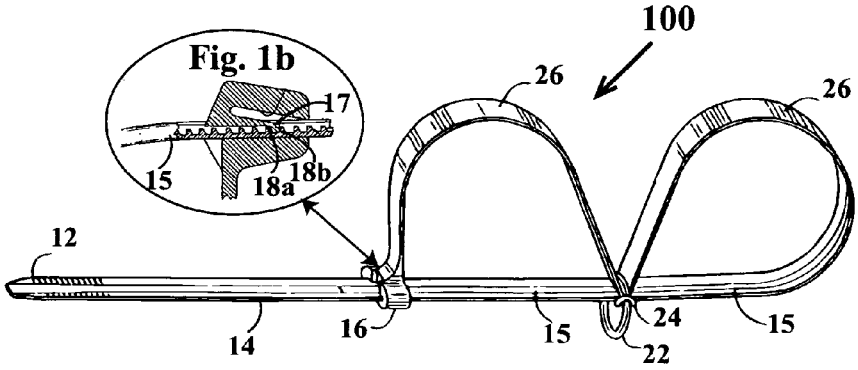
FIG. 1*a* schematically illustrates a prior art handcuff disclosed by U.S. Pat. No. 5,797,404 and design patent D366,733 to Stanchin, II.

Handcuffs of various geometries and made from metal and plastic have been known in the art. Metallic handcuffs have been used for a very long time. They are heavy and require keys to secure and unlock their metallic cuff portions. Moreover, an arresting officer can only carry a small number of handcuffs due to their bulk and weight. Plastic handcuffs have been fashioned, imitating the tie wrap geometry wherein a pawl engages with a ratchet. When the strap of the handcuff or tie wrap is pulled through the aperture that carries the pawl, the tip of the pawl engages with the ratchet, which generally has triangularly shaped elements. The pawl element falls within the space between nearly vertical tooth of the ratchet and the gently angled portion of the tooth. When the prisoner pulls against the tie wrap-like handcuff, the vertical wall of the ratchet resists the attempt. Inasmuch as both the pawl and ratchet are made from a polymeric material, they deform easily due to elastic modulus and strength of the polymeric member. This limits the constraining force with the result that the method of retaining a prisoner is easily overcome. In addition, due to the low strength of the polymeric parts of the handcuff, it is easy to shear the pawl or ratchet teeth.

The present invention discloses a handcuff that has several key constructional differences over the handcuff design disclosed in design patent D366,733. These constructional differences are listed below:

1) The locking mechanism of the device is structurally distinct;

2) The strap of the device is injection molded and has significantly larger width (3/8 inch) and thickness (3/32 inch) having a cross section 0.035 square inch.

3) The injection moldable strap polymer is polyamide 66 and polyamide 6 crystallized by heat treatment creating a strap material that has tensile strength at yield greater than 50 MPa or 7,251 psi. or the strap has a breaking strength greater than 0.035×7251 or 254 pounds;

4) The injection molded wide strap has a proximal end with a permanently attached head of reinforced polymeric box structure said box having an aperture and a bonded slanted sharp stainless steel knife with a slant angle of 10 to 40 degrees with respect to vertical direction;

5) The bonding between the slanted knife and the box head is created by one or more punched holes within the knife body through which injected molded polymer flows, forming a bolt-like bond that prevents twisting, tilting or dislodgement of said knife;

6) The strap distal end has a grabbing smooth surface for approximately 4 to 8 inches and the rest of the entire length of the upper surface having knife grabbing surface features that comprise closely spaced hillocks followed by deep valleys;

7) The strap forms a loop when the head and distal end are brought together and the distal smooth end of the strap is inserted within the aperture of the proximal head, so that inserting a central ring approximately midway forms two loops through which a the two hands of a prisoner or detainee's are inserted;

8) The slanted knife edge that rides in close fitting tolerance with hillocks of the strap slides past the hillocks due to the forward tilting angle of the knife edge and lands within the valleys, firmly securing the handcuff strap against the prisoner or detainee's hands; and 9) A pull of the strap in the opposite direction during an attempt to become free from the handcuff essentially locks the slanted knife edge within the valleys and prevents climbing of the knife over the adjacent hillock due to opposition created by the attitude of the slanted knife edge.

The knife-edge rides in a close tolerance distance from the tops of the hillocks. When the distal end of the strap is pulled through the aperture in the head, first the smooth portion comes out with minimal resistance. Additional pulling engages the knife edge that is inclined towards the strap pulling direction and the knife edge rides on the hillocks. Since the knife-edge is spaced in close tolerance with the hillocks provided on the upper surface of the strap, this pulling action pushes the knife edge upwards. The knife edge is however bonded to the rectangular shaped polymeric head of the strap which now deforms allowing the knife edge to lift so that it can clear the hillock. Once the top most portion of the hillock is cleared, the knife-edge descends downwards assisted by the spring constant of the deformed rectangular head, and finally rests on the valley provided between the hillocks. The strap is pulled progressive in the tightening direction by grabbing the smooth portion of the strap until sufficient restraining force is applied to the handcuffed hands of the prisoner or detainee. When the prisoner attempts to loosen the handcuff by wiggling or applying pressure, the strap is coerced to move in the direction opposite to that used to tighten the strap during the installation of the handcuff. The knife-edge now faces in a direction opposite to the strap movement direction that is required to release the handcuff. The knife-edge now digs into the hillocks and the rectangular head does not deform by the force applied by the prisoner to lift or raise the knife-edge above the hillocks. As a result, the knife-edge is securely held in place. This digging action creates a hand restraining force approaching 250 pounds, a value of restraining force that cannot be generated by the prisoner or detainee. In addition, the wiggling or twisting action by the prisoner in an attempt to be released from the handcuff does not result in further tightening of the handcuff. Owing to this digging action, blood flow to the hands of the prisoner is not restricted. On the other hand, restriction of blood flow to a prisoner's hands represents a feature commonly observed in prior art products and, when present can result in tissue damage. The only means to remove the fastened handcuff is to cut the polymeric strap, using a sharp specially designed cutting blade.

One of the additional features of the handcuff strap is that it has a pair of gussets that are provided at the location where the rectangular head attaches to the strap. The gussets extend outwards from the strap when wrapped around the wrists of the prisoner and prevent the rotation of the head as the prisoner or detainee twists and wiggles the strap. This twisting or wiggling motion is not transferred to the head and the knife-edge. Rather, the strap sustains the twisting and wiggling action. Thus the knife-edge, which is deeply dug in into the hillocks of the strap upper surface, is not loosened or dislodged.

Generally stated, the invention involves a lightweight portable easy to use handcuff that can be readily affixed to the wrists of a prisoner or detainee by pulling on the distal free end of the strap. The strap of the handcuff has a free end at its distal end and a head present at the proximal end. The head is generally rectangular in cross section similar to a frame and has an aperture which receives the distal end of the strap when assembled. The rectangular frame of the head has a permanently affixed slanted knife that has a knife-edge engaging with the upper surface of the strap. The upper surface of the strap has at its distal end a smooth hand grabbing surface for about 4 to 8 inches and a plurality of hillocks and deep valleys and the strap when folded passing the distal end of the strap through the aperture in the head allows direct contact of the knife-edge of the head with the hillocks of the upper surface of the strap. The distance between the knife-edge and the top of the hillocks is a critical dimension and is generally an interference fit in that some force is required to pull the strap through the aperture in the head. A ring is inserted through the folded strap and is placed at approximately half way thus forming two loops in the strap for the placement of the prisoner's wrists. The ring is free moving and self adjusting and may be made from steel or polymeric material such as polyamide 66 or polyamide 6 or a combination thereof. The handcuff is secured by pulling the distal end of the strap that passes through the aperture of the head. This results in the deformation of the rectangular frame of the proximal head, creating the tightening action of the strap against both of the prisoner's wrists. At the same time, the angled knife-edge passes over a hillock and falls into an adjacent valley. Any attempt to pull the strap immediately allows the edge of the slanted knife to dig into the adjacent hillock, locking the knife at the location selection. This locking action is further assisted by the release of the deformation of the rectangular frame of the head. Thus the handcuff is securely held at the selected location of the prisoner's wrists and defeats any attempt by the prisoner to twist or wiggle the handcuff, to loosen the securing grip. Further, the handcuff does not move to a tighter location since the knife-edge is securely held in place over the strap. This prevents over tightening of the handcuff and the possibility of blood flow loss to the prisoner's hands. The handcuff is removed by cutting the polymeric strap with a sharp specially designed knife, since the knife-edge locking mechanism cannot be defeated by tweezers, pliers, knives and other commonly available instruments.

The steel knife has to be secure when force is exerted by the prisoner to release the handcuff forcefully. The knife cannot dislodge, twist of lose close contact with the hillocks present on the upper surface of the strap. This secure attachment of the knife is accomplished by having one or more punched holes through the stainless steel blade knife. When the strap and head are molded together, the knife is placed in the location of the injection molding die that forms the rectangular portion of the head and the molten or softened polymer flows into the punched holes therein provided. The polymer then hardens by cooling these polymer passages through the holes of the knife, and in doing so, operates in the manner of a bolt to secure the knife from any movement.

FIG. 1*a* schematically illustrates at 100 the prior art disposable handcuff present in U.S. Pat. No. 5,797,404 and design patent D366,733 to Stanchin, II formed by inserting the distal end or tip 12 or a strap 14 through the terminal locking head 16 forming a loop. The loop is flattened having the tip 12 and head 16 at one first end 18 (not shown) and a fold at the opposite end 20 (not shown), at least enough to insert a ring 22 of a selected size over the selected end thereof. The ring 22 is slipped over the loop and spaced at a selected position generally at about the center of the loop. The first tip end 18 and second locking head end 20 of the loop are brought together and folded about the ring 22. A retaining means 24 such as an elastomer is slipped over and around the ring 22, (or over the folded loop), holding the strap 14 into the folded storage position centered on both sides of the ring 22; thereby revealing an open loop portion of the ring 22 at the top for grasping. In use, pull the disposable handcuff 100 from the storage pouch or pocket. Grab hold of the first end 18 and the second end 20 with each hand, and pull. Assembly of the disposable cuff 100 is such that the retaining means 24 holds the loop folded around the ring 22 together under tension due to the memory of the plastic in the strap 14. Upon pulling, the elastomer retaining means 24 will be biased over the ring 22 by the tension provided by the bending of the strap 14 and snap over the ring 22 effortlessly, or break the retaining means 24, whereby the detainee's hands may be placed through the double strap loops 26 formed and separated by the metal ring 22. The first tip end 18 is then pulled and the ratchet and pawl cooperates to tighten the loops around both wrists of the detainee at the same time with a single motion. The pawl and ratchet arrangement as detailed by the referenced U.S. Pat. No. 5,193,254 to Geisinger is shown in FIG. 1*b*. In this figure, when the strap is pulled, the pawl 17 moves from ratchet 18*a* to ratchet 18*b* and the constraining capability of the strap is limited to the strength of the pawl 15, which is a polymeric product and can be pulled away.

Figure 2A:
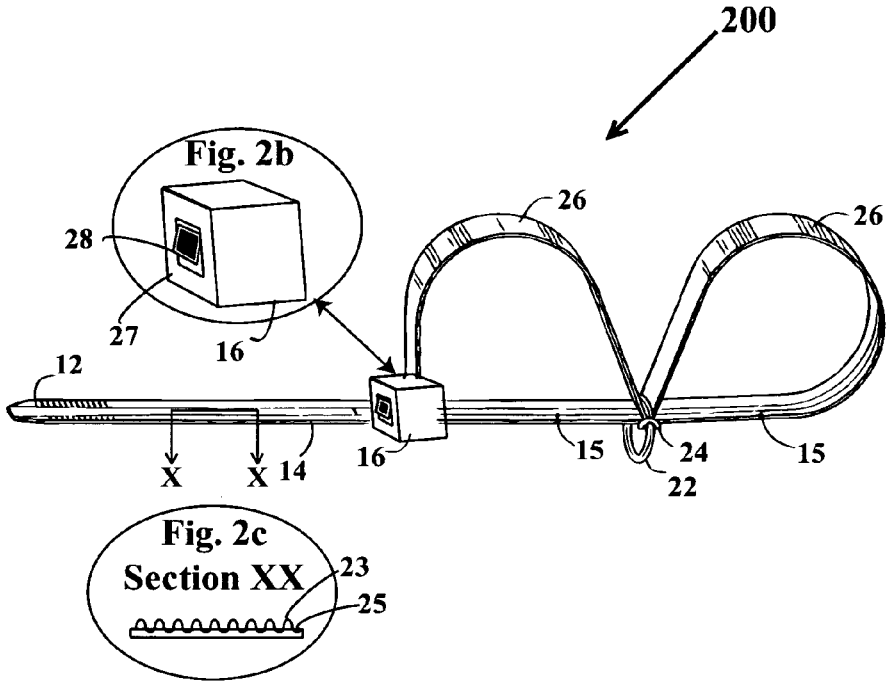
FIG. 2*a* schematically illustrates a handcuff according to present invention.

FIG. 2*a* schematically illustrates at 200 the handcuff according to present invention. The strap configuration is similar to FIG. 1*a* and identical numerical indicia are used for common features. The head of the strap and the type of securement of the cuff is distinctly different. The exploded FIG. 2*b* illustrates the structural details of the strap head. Rectangular portion 27 of the strap head is deformable and carries a slanted knife 28 with a sharp knife-edge at the portion that contacts the strap. Exploded FIG. 2*c* illustrates the details of the upper surface of the strap at various locations. The strap has a distal end 12 that has a smooth easy to grab portion for about 4 to 8 inches. The upper surface of the strap beyond the smooth portion has knife grabbing features consisting of a plurality of hillocks separated by valleys. The cross section along XX of FIG. 2*a* is depicted by inserted FIG. 2*c*, showing the hillocks and valleys.

Figure 3A:
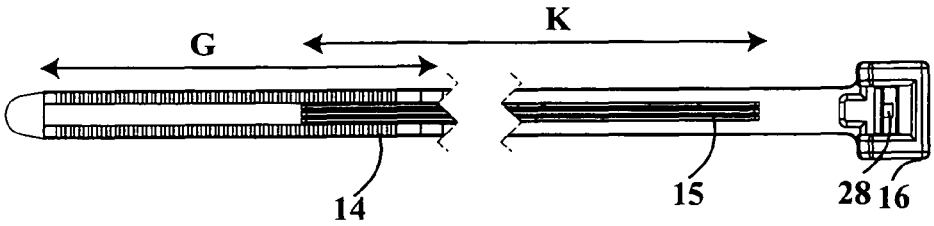
FIG. 3*a* illustrates the plan view of the upper surface of the strap.

FIG. 3*a* illustrates a plan view of the strap. The distal end of the strap is shown at 12 in FIG. 3*b*. A smooth grabbing portion is indicated at G. The knife grabbing hillock valley features are present on the upper surface of the strap at K and are marked with numeral 15. The head 16 of the strap is shown in this plan view and the slanted sharp knife is shown at 28.

Figure 3B:
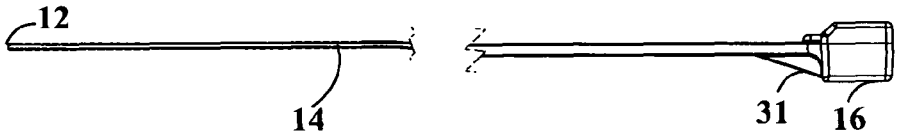
FIG. 3*b* illustrates the plan view of the side view of the strap.

FIG. 3*b* illustrates a side view of the strap. Identical indicia are used for various parts of the strap. The side of the strap opposite to the knife grabbing features has two gussets 31 at the molded attachment injection between the strap and the head, and these gussets prevent the rotation of the head and the knife contained therein even when the prisoner twists the handcuff.

Figure 3C:
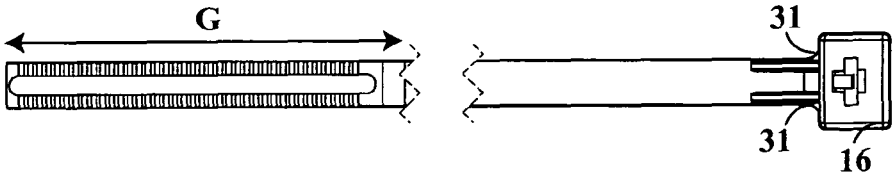
FIG. 3*c* illustrates the bottom view of the strap.

FIG. 3*c* illustrates the bottom view of the strap and the gussets 31 are clearly seen where the strap attaches to the head.

Figure 4A:
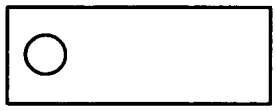
FIG. 4*a* illustrates the front view of the knife.

FIG. 4*a* shows the front view of the stainless steel knife with one hole provided for flow of injected molded polymer. Use of additional holes is also contemplated and is not shown here for clarity.

Figure 4D:
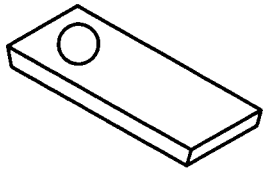
FIG. 4*d* illustrates an isometric view of the knife.
Figure 4B:
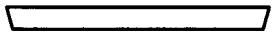
FIG. 4*b* illustrates the plan view of the knife.

FIG. 4*b* shows the plan view of the stainless steel knife. The knife is sharpened at a 15 degree angle. As detailed earlier, the knife is embedded within the rectangular portion of the head maintaining a slanted position of the knife that protrudes from the head.

Figure 4C:
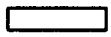
FIG. 4*c* illustrates the side view of the knife.

FIG. 4*c* illustrates a side view of the stainless steel knife.

FIG. 4*d* illustrates an isometric view of the stainless steel knife.

Figure 5:
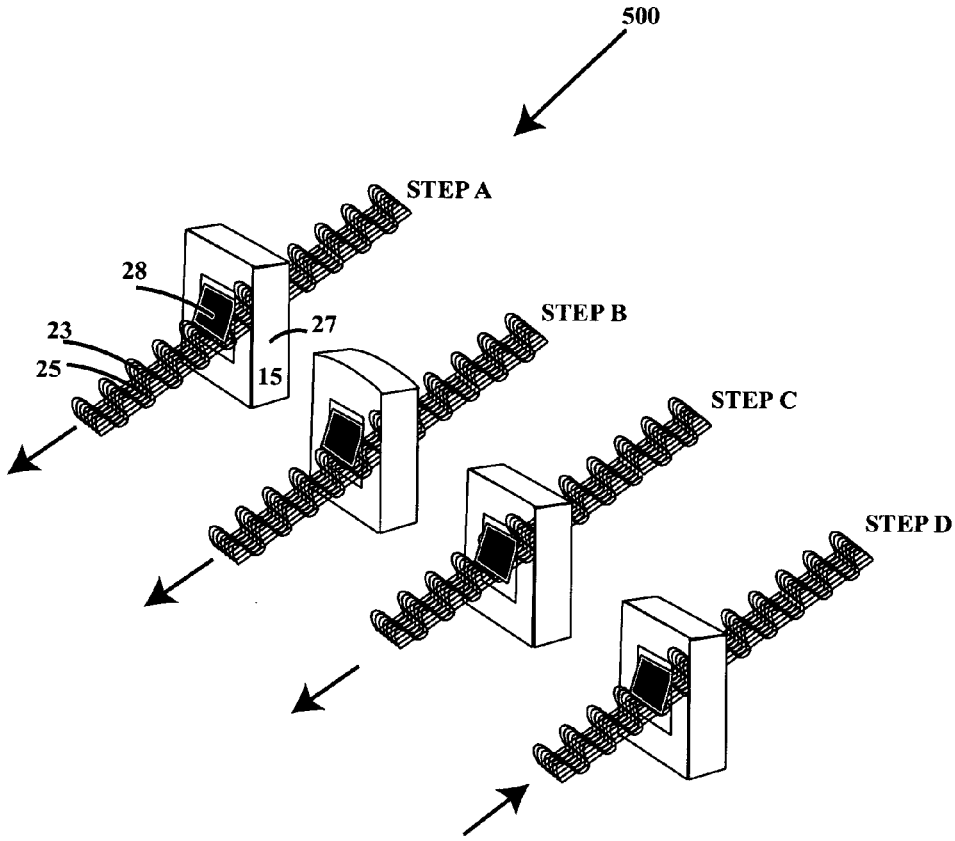
FIG. 5 illustrates details concerning the head and the position of the slanted knife with respect to the hillocks: during the insertion of the strap through the aperture in the head (Step A), during tightening by pulling the smooth portion of the strap distal end (Step B), after the handcuff is tightened, securing the prisoner's wrists (Step C) and finally when the prisoner tries to loosen the handcuff (Step D)

FIG. 5 illustrates details of the head and the slanted knife with respect to the hillocks: (i) during the insertion of the strap through the aperture in the head (Step A); (ii) during tightening by pulling the smooth portion of the strap distal end (Step B); (iii) after the handcuff is tightened securing the prisoner's wrists (Step C); and (iv) when the prisoner tries to loosen the handcuff (Step D). In the steps shown in FIG. 5, the strap is not shown for clarity. Only the hillocks 23 and valleys 25 are present in the upper surface of the strap. At step A, the strap is inserted through the aperture provided in the rectangular portion of the head 27. The slanted knife 28 is interfering with the top of the hillock. The strap is pulled by grabbing the smooth portion and moves along the arrow direction. Note that the angle of the slanted knife assists the slipping of the knife edge over the hillock, especially when the rectangular portion of the head deforms as shown in Step B. Now that the knife edge has cleared the hillock, the knife edge drops easily into the valley and the deformation of the rectangular head relaxes, as shown at step C. At this point, the handcuff has been tightened against the wrists of the prisoner and the securement of the handcuff is complete. If the prisoner were to apply pressure against the handcuff or twist the handcuff, the knife edge digs into the next hillock adjacent to the valley where it is resting and prevents any relaxation or movement of the head. In this manner, the grip on the prisoner's wrists is not relaxed, and the handcuff does not over tighten to block blood flow to the prisoner's hands.

Having thus described the invention in rather full detail, it will be understood that such detail need not be strictly adhered to, but that additional changes and modifications may suggest themselves to one skilled in the art. For example, two or more of the handcuffs 200 may be combined to form leg restraints as well as arm restraints, or deployed as a belt of restraints connecting several prisoners in a continuous chain. The handcuff 200 can be used to form a super high strength cable tie or the like. Such changes and modifications are considered to fall within the scope of the invention as defined by the subjoined claims.

What is claimed is:

1. An injection molded compact, lightweight polymeric handcuff comprising:

a) a strap with a distal end comprising a smooth easy-to-grab region, a central portion having knife grabbing features on the upper surface and a proximal end comprising a head having an aperture;

b) said strap head comprising a rectangular deformable portion surrounding said aperture carrying an integrally injection molded steel slanted knife having a sharp knife-edge, said knife having one or more apertures therein for allowing flow thereinto of molten or softened injection molding polymer, thereby creating an integral bond between the knife and the rectangular portion of the head;

c) said distal end of said strap, when inserted into said aperture of the head, forming a folded strap and a ring, when inserted nearly at mid point of said folded strap, forming two loops for placing the hands of a prisoner therethrough;

d) said knife grabbing features comprising a plurality of hillocks separated by valleys present along the full length on the upper surface of the strap, and said knife-edge interfering with said knife grabbing features when inserted into aperture of said head;

e) said slanted knife-edge being operative to clear said knife grabbing features of hillocks by elastic deformation of said rectangular portion of the head when said strap is pulled through the aperture to secure said handcuff and restrain the prisoner;

f) said knife-edge landing in the valley between hillocks assisted by the release of elastic deformation of the rectangular portion of the head when the handcuff is tightened on the prisoner's wrists;

g) attempts by the prisoner to release the handcuff by pulling, twisting or wiggling the handcuff being operative to dig the knife edge into an adjacent hillock, thereby locking the handcuff against movement of the strap through the aperture; and h) said strap being provided with a pair of gussets operative to prevent twisting of said head or knife-edge;

whereby the handcuff securely constrains the prisoner at the selected location and does not over tighten to constrict blood supply to the prisoner's hands.

2. The injection molded compact lightweight polymeric handcuff, as recited by claim 1, wherein said strap sustains a wrists separating load of about 250 pounds.

3. The injection molded compact lightweight polymeric handcuff as recited by claim 1, wherein said knife-edge locking against valley provided on said upper surface of said strap sustains a wrists separating load of about 250 pounds.

4. The injection molded compact lightweight polymeric handcuff as recited by claim 1, wherein, said strap is injection molded with a polymer selected from polyamide 66, polyamide 6 and a combination thereof.

5. The injection molded compact lightweight polymeric handcuff as recited by claim 1, wherein, said smooth grabbing portion of said strap is 4 to 8 inches.

6. The injection molded compact lightweight polymeric handcuff as recited by claim 1, wherein, said slanted knife has an angle with respect to said vertical of 10 to 40 degrees.

7. The injection molded compact lightweight polymeric handcuff as recited by claim 1, wherein, said ring is a steel ring.

8. The injection molded compact lightweight polymeric handcuff as recited by claim 1, wherein said ring is a polyamide ring.

9. The injection molded compact lightweight polymeric handcuff as recited by claim 8, wherein said ring is composed of high strength nylon.

10. The injection molded, compact lightweight polymeric handcuff as recited by claim 9, wherein said ring and said strap have substantially the same color.

11. The injection molded compact lightweight polymeric handcuff as recited by claim 1, wherein said handcuff is produced in a variety of colors.

12. The injection molded compact lightweight polymeric handcuff as recited by claim 1, wherein said handcuff is removed from the wrists of a prisoner by cutting the strap.

* * * * *